US006850007B2

(12) United States Patent
Shinoda et al.

(10) Patent No.: US 6,850,007 B2
(45) Date of Patent: Feb. 1, 2005

(54) PLASMA DISPLAY PANEL ASSEMBLY AND METHOD FOR MANUFACTURING THE SAME

(75) Inventors: Tsutae Shinoda, Akashi (JP); Noriyuki Awaji, Akashi (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/289,245

(22) Filed: Nov. 7, 2002

(65) Prior Publication Data

US 2003/0141817 A1 Jul. 31, 2003

(30) Foreign Application Priority Data

Jan. 30, 2002 (JP) ..... 2002-022464

(51) Int. Cl.[7] ..... H01J 17/49
(52) U.S. Cl. ..... 313/587; 313/582
(58) Field of Search ..... 313/582–587

(56) References Cited

U.S. PATENT DOCUMENTS 5,066,620 A * 11/1991 Sunahara et al. ..... 501/21
5,909,083 A * 6/1999 Asano et al. ..... 313/584
2002/0042025 A1 * 4/2002 Tokai et al. ..... 430/321

FOREIGN PATENT DOCUMENTS

| | | | | |
|---|---|---|---|---|
| JP | 01112605 A | * | 5/1989 | ..... H01B/1/16 |
| JP | 02230605 A | * | 9/1990 | ..... H01B/1/16 |
| JP | 2002367518 A | * | 12/2002 | ..... H01J/11/02 |
| JP | 2002373592 A | * | 12/2002 | ..... H01J/11/02 |
| RU | 2185678 C1 | * | 7/2002 | ..... H01J/17/49 |

* cited by examiner

*Primary Examiner*—Nimeshkumar D. Patel
*Assistant Examiner*—German Colón
(74) *Attorney, Agent, or Firm*—Staas & Halsey LLP

(57) ABSTRACT

A plasma display panel assembly includes electrodes and a dielectric layer covering the electrodes. The dielectric layer is formed of a low-melting-point glass, and the electrodes are formed of a metal containing a crystallized glass. The metal and the low-melting-point glass are simultaneously fired to complete the electrodes and the dielectric layer. Thus, in a manufacturing process of an AC plasma display panel, the number of firing steps can be reduced.

8 Claims, 7 Drawing Sheets

PLASMA DISPLAY PANEL ASSEMBLY AND METHOD FOR MANUFACTURING THE SAME

BACKGROUND OF THE INVENTION

1. Field of the Invention

The present invention relates to plasma display panels which display color images using gas discharge, and particularly to a structure for surface-discharge ac plasma display panels which makes it possible to easily fabricate the plasma display panels and their front and back panels and to a method for manufacturing the plasma display panels.

2. Description of the Related Art

Surface-discharge ac plasma display panels have been put into practical use for large full-color flat display devices. These panels each have a front panel and a back panel with discharge gas filled therebetween. The front panel comprises a front substrate and pairs of display electrodes disposed on the front substrate along display lines of the front panel. The back panel comprises a back substrate and fluorescent phosphors superposed on the back substrate. A surface discharge from each pair of display electrodes generates vacuum ultraviolet light which causes the fluorescent phosphors to emit visual light, and thus color images can be displayed. In general, the display electrodes are covered with a dielectric layer formed of a low-melting-point glass, and black stripes are disposed between the pairs of display electrodes to increase the contrast ratio of displayed images. The back panel has address electrodes covered with a dielectric layer and extending under the fluorescent phosphors so as to cross the display electrodes. Barrier ribs (often referred to as barrier walls) for partitioning the discharges are also disposed so as to correspond to the address electrodes.

However, in the manufacturing process of the known plasma display panel, the electrodes, the dielectric layers, the barrier ribs, and other components must be formed and then fired separately, as shown in the flow charts of manufacturing processes in FIGS. 6 and 7. Therefore the front panel, which includes the display electrodes and the dielectric layer (having a two-layered structure) must be fired three times, and the back panel, which includes the address electrodes, the dielectric layer, and the barrier ribs must be fired four times. In the flow chart in FIG. 6, the dielectric layer of the front panel is composed of a lower layer and an upper layer. The lower layer is fired at a temperature around the softening point of the constituent thereof to prevent reaction with the display electrodes, and the upper layer is fired at a temperature 100° C. higher than the softening point of the constituent thereof so that the surface of the upper layer become smooth. The dielectric layer of the front panel can have a monolayer structure by selecting the material of the display electrodes. In this instance, the front panel is fired twice. As described above, the known plasma display panel having the front panel and the back panel requires a lot of firing steps. It takes 4 to 5 hours to perform each firing step and, thus, the entire manufacturing process is long. Also, such a large number of steps leads to a reduced manufacturing yield.

SUMMARY OF THE INVENTION

Accordingly, an object of the present invention is to provide a plasma display panel whose electrodes are formed of a metallic paste containing a crystallizable glass and, thus, to reduce the number of firing steps.

According to one aspect of the present invention, there is provided a plasma display panel assembly. The plasma display panel assembly includes a substrate and electrodes disposed on the substrate. The electrodes are formed of a metal containing a crystallized glass. A dielectric layer covers the electrodes and is formed of a low-melting-point glass.

The dielectric layer and the electrodes may be formed by simultaneously firing a low-melting-point glass paste and a metallic paste containing a metallic powder.

Preferably, the crystallization peak temperature of the crystallized glass is lower than the softening point of the low-melting-point glass.

Preferably, the metallic powder contained in the metallic paste includes silver or silver-palladium.

According to another aspect of the present invention, a front panel assembly of a plasma display panel is provided which includes a transparent substrate and a plurality of display electrodes extending in one direction on the transparent substrate. The display electrodes each have a transparent conductive film and a metallic film containing a crystallized glass. A dielectric layer covers the display electrodes and is formed of a low-melting-point glass.

The front panel assembly may further include light-shielding films formed of a black insulating material containing a crystallized glass. Display electrode pairs are each defined by two adjacent display electrodes, and each light-shielding film is disposed between one display electrode pair and another adjacent display electrode pair in parallel with the display electrodes.

According to another aspect of the present invention, a back panel assembly of a plasma display panel is provided which includes a substrate and a plurality of address electrodes extending in one direction on the substrate. The address electrodes are formed of a metal containing a crystallized glass. A dielectric layer covers the address electrodes and is formed of a low-melting-point glass. Barrier ribs for partitioning discharge spaces are disposed on the dielectric layer and are formed of a low-melting-point glass.

According to a methodological aspect of the present invention, there is provided a method for manufacturing a plasma display panel assembly having a plurality of electrodes extending in one direction on a substrate and a dielectric layer covering the electrodes. The method includes the steps of: applying a metallic paste containing a crystallizable glass to the regions on a substrate where the electrodes are to be formed: applying a low-melting-point glass paste onto substantially the entire surfaces of the substrate and the metallic paste; and firing the metallic paste and the low-melting-point glass paste simultaneously.

According to another methodological aspect of the present invention, there is provided a method for manufacturing a front panel assembly of a plasma display panel having a plurality of display electrode pairs extending in one direction on a substrate, light-shielding films each disposed between one display electrode pair and another adjacent display electrode pair in parallel with the display electrode pairs, and a dielectric layer covering the display electrode pairs and the light-shielding films. The method includes the steps of: applying a metallic paste containing a crystallizable glass to the regions on a substrate where the electrodes are to be formed; applying a black insulating paste containing a crystallizable glass to the region on the substrate where the light-shielding films are to be formed; applying a low-melting-point glass paste onto substantially the entire surfaces of the substrate, the metallic paste, and the black insulating paste; and firing the metallic paste, the black insulating paste, and the low-melting-point glass paste simultaneously.

According to another methodological aspect of the present invention, there is provided a method for manufacturing a back panel assembly of a plasma display panel having a plurality of address electrodes on a substrate, a dielectric layer covering the address electrodes, and barrier ribs for partitioning discharge spaces on the dielectric layer. The method includes the steps of: applying a metallic paste containing a crystallizable glass to the regions on the substrate where the address electrodes are to be formed; applying a low-melting-point glass paste onto substantially the entire surfaces of the substrate and the metallic paste; applying a barrier wall material containing a low meting point glass to predetermined regions on the low-melting-point glass paste; and firing the metallic paste, the low-melting-point glass paste, and the barrier rib material simultaneously.

According to another aspect of the present invention, a surface-discharge ac plasma display panel is provided which includes the above-described front panel assembly and back panel assembly.

According to another aspect of the present invention, a method for manufacturing a plasma display panel assembly is provided which includes the steps of: applying a conductive paste containing a low melting point crystallizable glass powder onto the substrate to form a thick electrode pattern; applying a low-melting-point glass paste containing a low-melting-point glass so as to cover the thick electrode pattern; and firing the thick electrode pattern and the low-melting-point glass paste simultaneously.

Preferably, the crystallization temperature of the low-melting-point crystallizable glass powder is lower than the softening point of the low-melting-point glass, so that the low-melting-point crystallizable glass powder is crystallized before the low-melting-point glass softens.

According to the present invention, the number of the firing steps in front panel fabrication, which is conventionally at least two, is reduced to one; and the number of firing steps in back panel fabrication, which is conventionally four, is reduced to two. Accordingly, the number of steps in the process for manufacturing the plasma display panel can be reduced, and this helps provide a high-quality plasma display panel at low cost.

DESCRIPTION OF THE PREFERRED EMBODIMENTS

Figure 1:
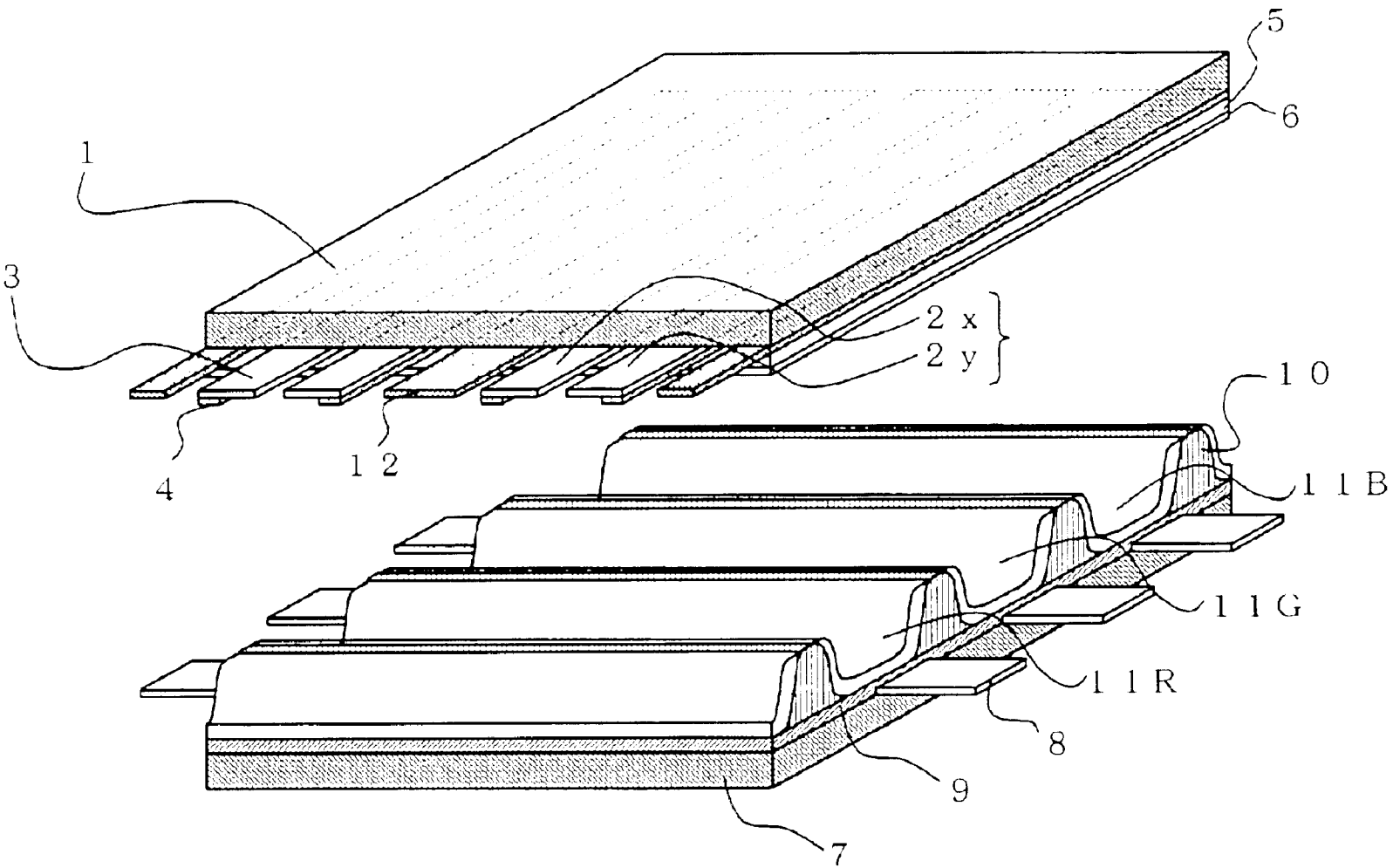
FIG. 1 is an exploded perspective view of a three-electrode surface-discharge ac plasma display panel according to the present invention.
Figure 2:
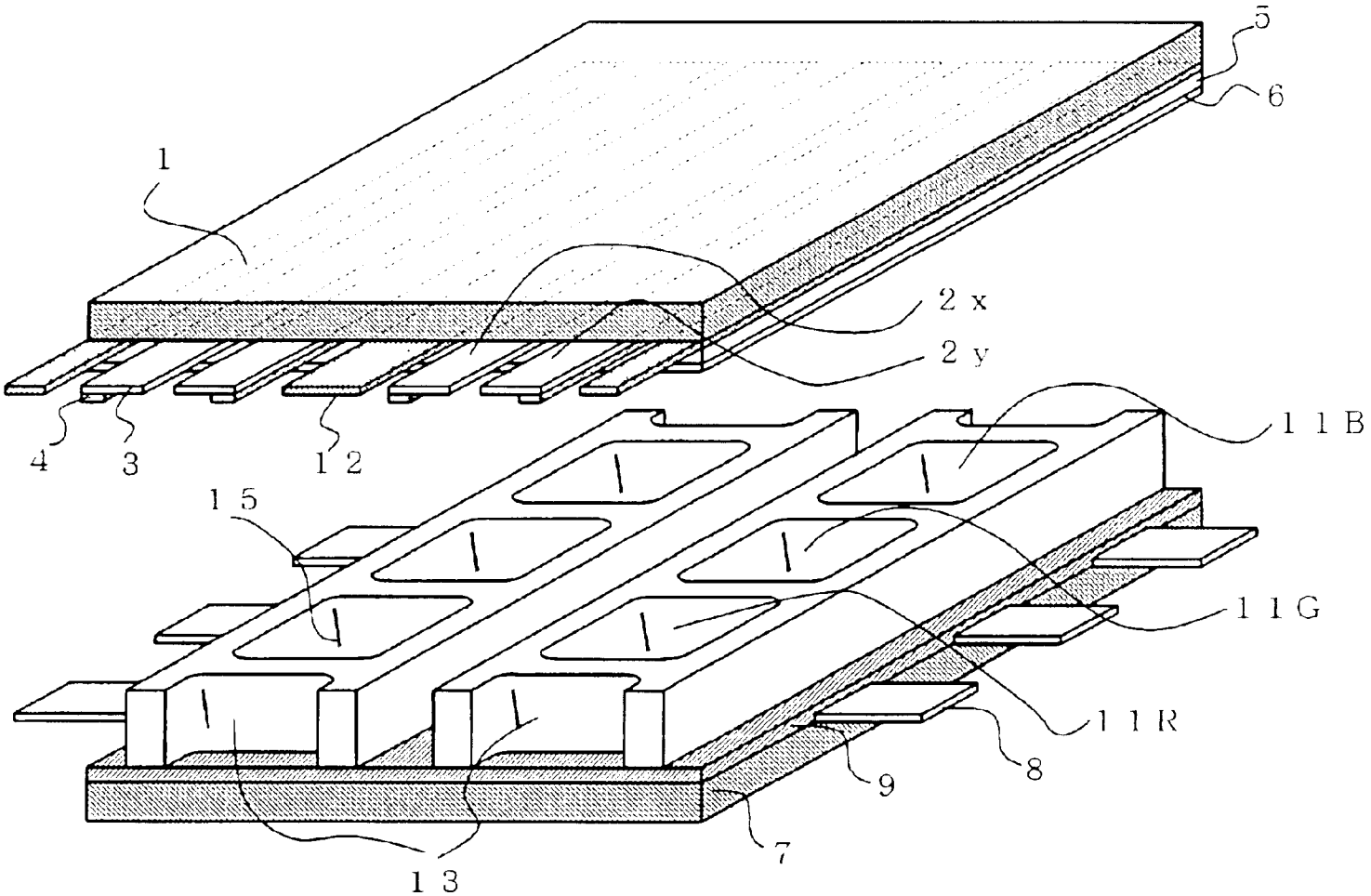
FIG. 2 is an exploded perspective view of a three-electrode surface-discharge ac plasma display panel having curb-like barrier ribs, according to the present invention.
Figure 3:
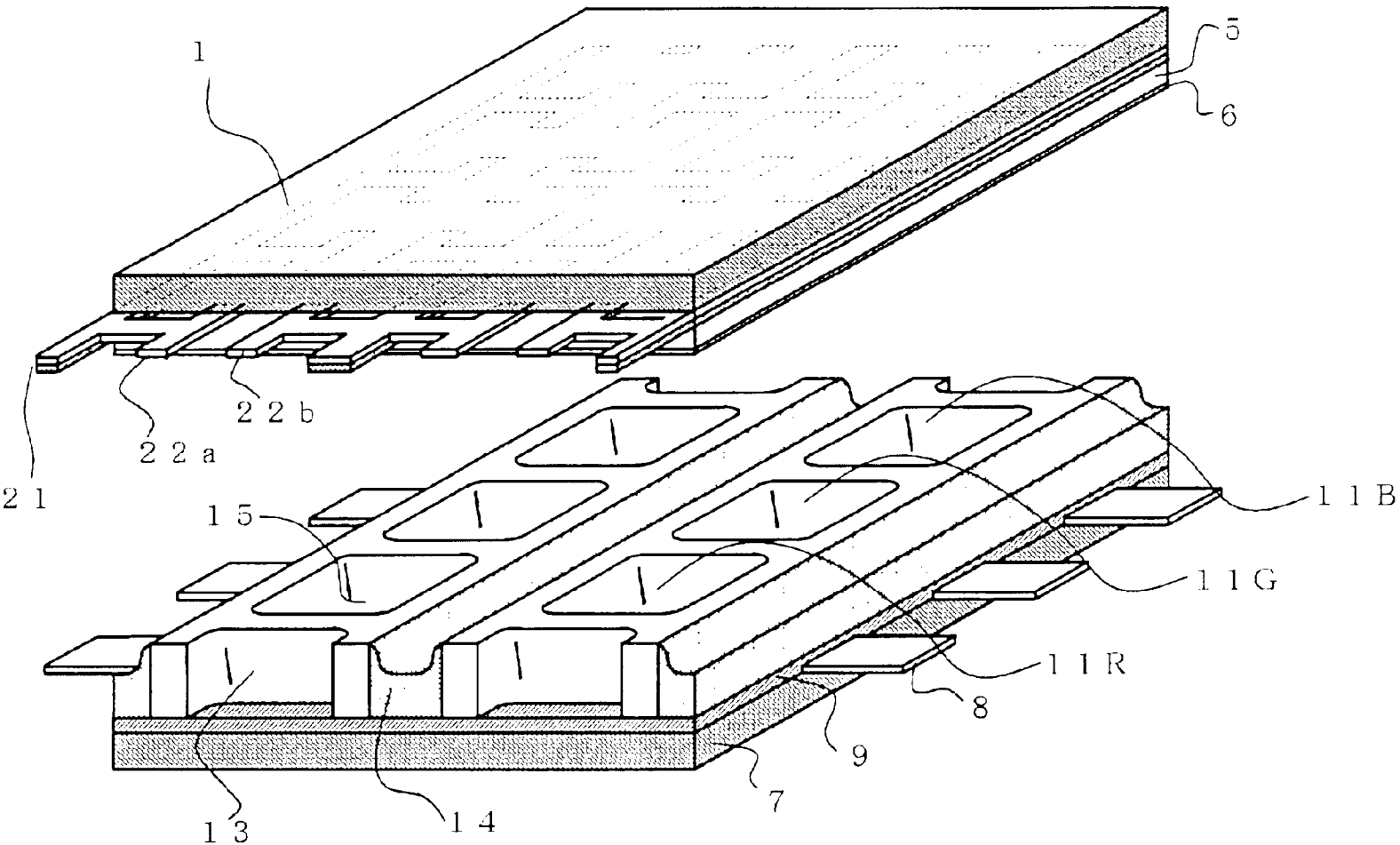
FIG. 3 is an exploded perspective view of a three-electrode surface-discharge ac plasma display panel using the ALIS system, according to the present invention.

FIGS. 1 to 3 are exploded perspective views of three-electrode surface-discharge ac plasma display panels of the present invention. The plasma display panel shown in FIG. 1 has a typical, so-called stripe rib structure. A front substrate 1 is formed of transparent glass. A plurality of display electrode pairs composed of two adjacent display electrodes 2*x* and 2*y* are disposed on an inner surface of the front substrate 1 along the regions where display lines are to be formed. Light-shielding black stripes 12 for blocking light are disposed between the display electrode pairs to increase the contrast ratio of displayed images. The black stripes 12 are formed of a black insulating material containing a crystallized glass, and will be described in detail later. The display electrodes 2*x* and 2*y* and the black stripes 12 are covered with a front dielectric layer 5 and a MgO protecting layer 6. Each of the display electrodes 2*x* and 2*y* includes an ITO transparent electrode 3 and a metallic bus electrode 4. The bus electrode 4 is formed of a metal containing a crystallized glass resulting from a metallic paste containing crystallizable glass powder, and will be described in detail later. The transparent electrodes 3 are disposed in a straight manner, in FIG. 1. However, they may be disposed at each discharge cell in a T-shape, I-shape, comb-like, or ladder pattern. Also, in the drawing, the display electrodes are each composed of the transparent electrode 3 and the bus electrode 4, but the transparent electrode 3 may be replaced with an electrode formed of the metallic paste for the bus electrode 4.

A back substrate 7 is formed of the same glass as in the front substrate 1. The back substrate 7 is provided with a plurality of address electrodes 8 on the upper surface thereof so as to extend in the direction crossing the display electrodes 2*x* and 2*y*, and is covered with a back dielectric layer 9 formed of a low-melting-point glass. The address electrodes 8 are also formed of a metal containing a crystallized glass resulting from a metallic paste containing a crystallizable glass powder. Barrier ribs 10 are disposed on the back dielectric layer 9 in a striped manner so as to be positioned between the address electrodes. Red, green, and blue fluorescent phosphors 11R, 11G, and 11B are separately applied to the cavities defined by the barrier walls 10 so as to cover the bottoms of the cavities and the side surfaces of the barrier ribs 10.

FIG. 2 shows a plasma display panel having a mesh-like barrier rib structure similar to a waffle. In this plasma display panel, the barrier ribs 10 shown in FIG. 1 are replaced with mesh-like barrier ribs 13 for defining discharge spaces 15 corresponding to discharge cells, on the back dielectric layer 9. The discharge spaces 15 define discharge cavities or discharge cells at the regions corresponding to the intersections of the display electrode pairs and the address electrodes 8. Red, green, and blue fluorescent phosphors 11R, 11G, and 11B are applied to the inner surfaces of the mesh-like barrier ribs 13 one by one, in the longitudinal direction of the display electrodes 2*x* and 2*y*. The bus electrodes 4 and the address electrodes 8 are formed of a metal containing a crystallized glass. The black stripes 12 are also formed of a black insulating material containing a crystallized glass.

FIG. 3 shows an ALIS (alternative lighting of surfaces) plasma display panel, which can display full-pitch images by interlacing. In this plasma display panel, a plurality of bus electrodes 21 are disposed, on the inner surface of the front substrate 1, at regular intervals along the display lines, and pairs of T-shaped transparent electrodes 22*a* and 22*b* are disposed at both sides of the bus electrodes at predetermined intervals. The mesh-like barrier ribs 13 are disposed on the back substrate 7 to define discharge cells at the regions corresponding to the pairs of T-shaped electrodes 22*a* and 22*b*. Red, green, and blue fluorescent phosphors 11R, 11G, and 11B are applied separately to the mesh-like barrier walls 13 in the discharge cells, and black films 14 are disposed in cavities between the barrier ribs 13, which are positioned in the regions corresponding to the bus electrodes 21, to increase the contrast ratio of images. Accordingly, the black films 14 are not necessary. The bus electrodes 21 and the address electrodes 8 of this panel are also formed of a metal containing a crystallized glass, and the black films 14 are formed of a black insulating material containing a crystallized glass.

A method for fabricating the front panel of the present invention will now be described with reference to FIG. 4.

In step 1, an ITO layer is deposited to a thickness in the range of 0.1 to 0.3 $\mu$m on a glass substrate by sputtering or the like, and is then patterned by photolithography to form a transparent electrode pattern. If the display electrodes are formed of only the material of the bus electrodes, step 1 is skipped.

In step 2, bus electrodes are formed to a thickness of about 10 $\mu$m using metal paste containing a crystallizable glass powder, a silver or silver-palladium powder, an organic binder, and an organic solvent. The bus electrodes are formed by a known method in which, for example, the metallic paste is screen-printed to form an electrode pattern or is applied to the entirety or part of the surface of the front substrate and then patterned by photolithography. In the latter case, preferably, a photosensitive material is added to the metal paste. After the formation of the bus electrodes, black stripes are disposed between display electrode pairs and on the substrate.

The black stripes are formed of a black insulating paste containing a crystallizable glass powder, an organic binder, and an organic solvent, as in the bus electrodes. The black insulating paste also contains an oxide of iron, chromium, nickel, manganese, or the like or an oxide complex of these metals. The method for forming the black stripes is the same as in the bus electrodes. Preferably, the crystallizable glass powder contained in the black insulating paste has the same composition as that of the crystallizable glass powder contained in the metallic paste of the bus electrodes.

In step 3, a low-melting-point glass paste containing a low-melting-point glass powder, an organic binder, and an organic solvent is applied to the surface of the front substrate where the transparent electrodes, the bus electrodes, and the black stripes are disposed. The low-melting-point glass paste is applied by screen printing, a green sheet method, roll coating, or dye coating. Preferably, the low-melting-point glass powder has a softening point in the range of about 560 to 590° C., and, preferably, this softening point is higher than the crystallization peak temperature of the crystallizable glass powder contained in the metallic paste. Specifically, the crystallizable glass powder in the metallic paste is crystallized, so that the metallic powder particles in the metallic paste are bonded to one another and to the front substrate before the low-melting-point glass powder is softened. The bus electrodes thus adhere to the substrate and, consequently, the bus electrodes do not bend, break, or separate from the substrate even when the dielectric layer softens. The same holds true for the black stripes. Thus, the bus electrodes, the black stripes, and the dielectric layer can be simultaneously fired in step 4. Since known metallic pastes contain amorphous glass powder, the amorphous glass softens as the temperature increases during firing. The known metallic pastes are, therefore, liable to cause the bus electrodes to bend, break, or separate from the substrate. In contrast, a crystallizable glass powder is crystallized and hardened as the temperature increases beyond its softening point to the crystallization peak temperature. However, if the crystals of the crystallized glass grow too large, the conductivity of the electrodes resulting from the metallic paste decreases. Therefore the crystal size must be appropriately set by controlling the glass composition and the firing conditions.

In step 4, simultaneous firing is performed at a temperature of 570 to 600° C. depending on the softening point of the low meting point glass powder. The heating rate is set such that, before the temperature reaches the firing temperature, the crystallizable glass powder of the bus electrodes and the black stripes is completely crystallized or crystallized at a level where the bending, breaking, or separation of the bus electrodes and the black stripes do not occur. For example, the heating rate is reduced or the temperature is maintained constant for a predetermined period of time during firing. The time for which the temperature is maintained constant may be set at 10 to 60 min.

A method for fabricating the back panel of the present invention will now be described with reference to FIG. 5. The same description as in FIG. 4 is not repeated.

Figure 4:
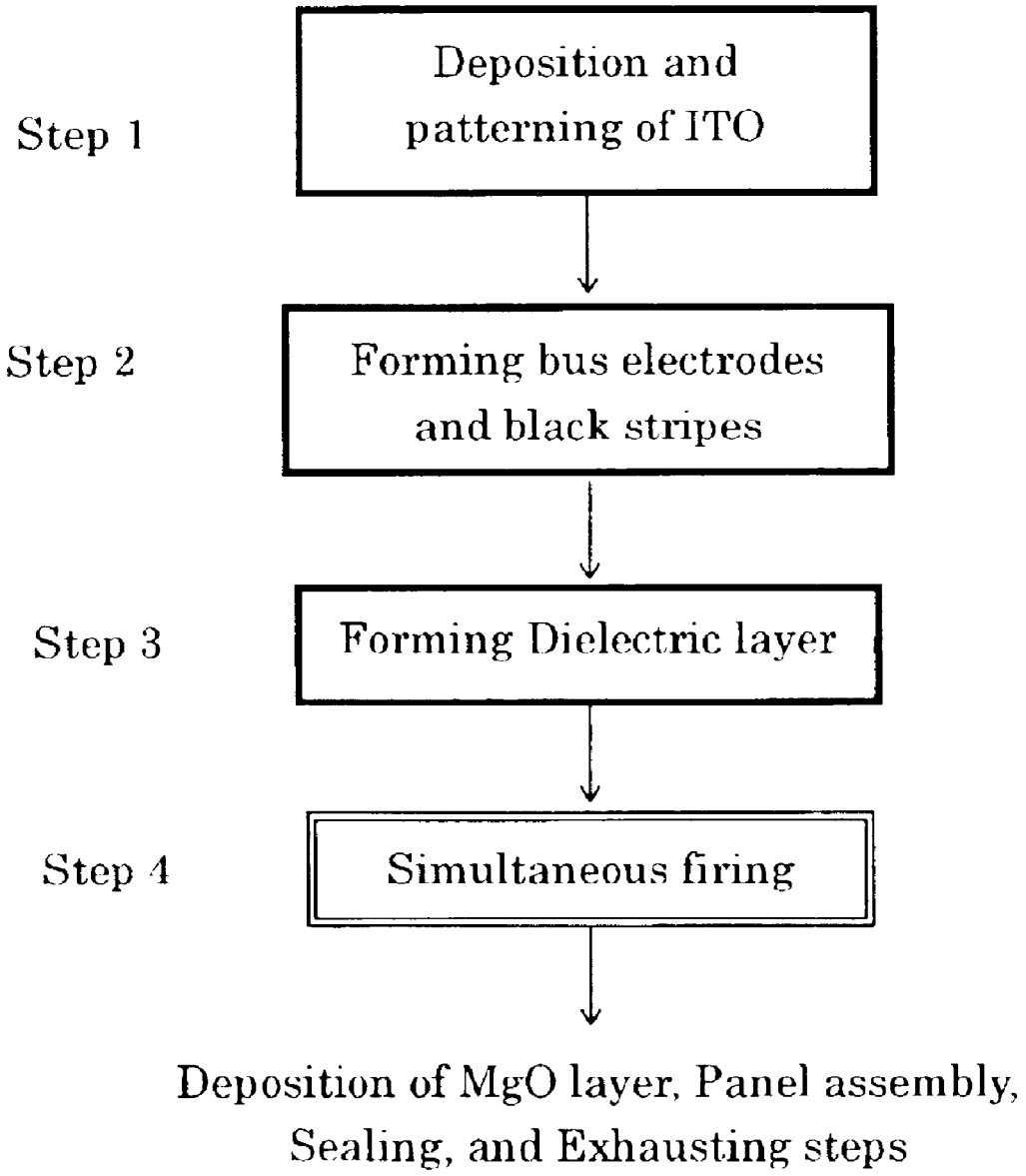
FIG. 4 is a flow chart showing a manufacturing process of a front panel according to the present invention.
Figure 5:
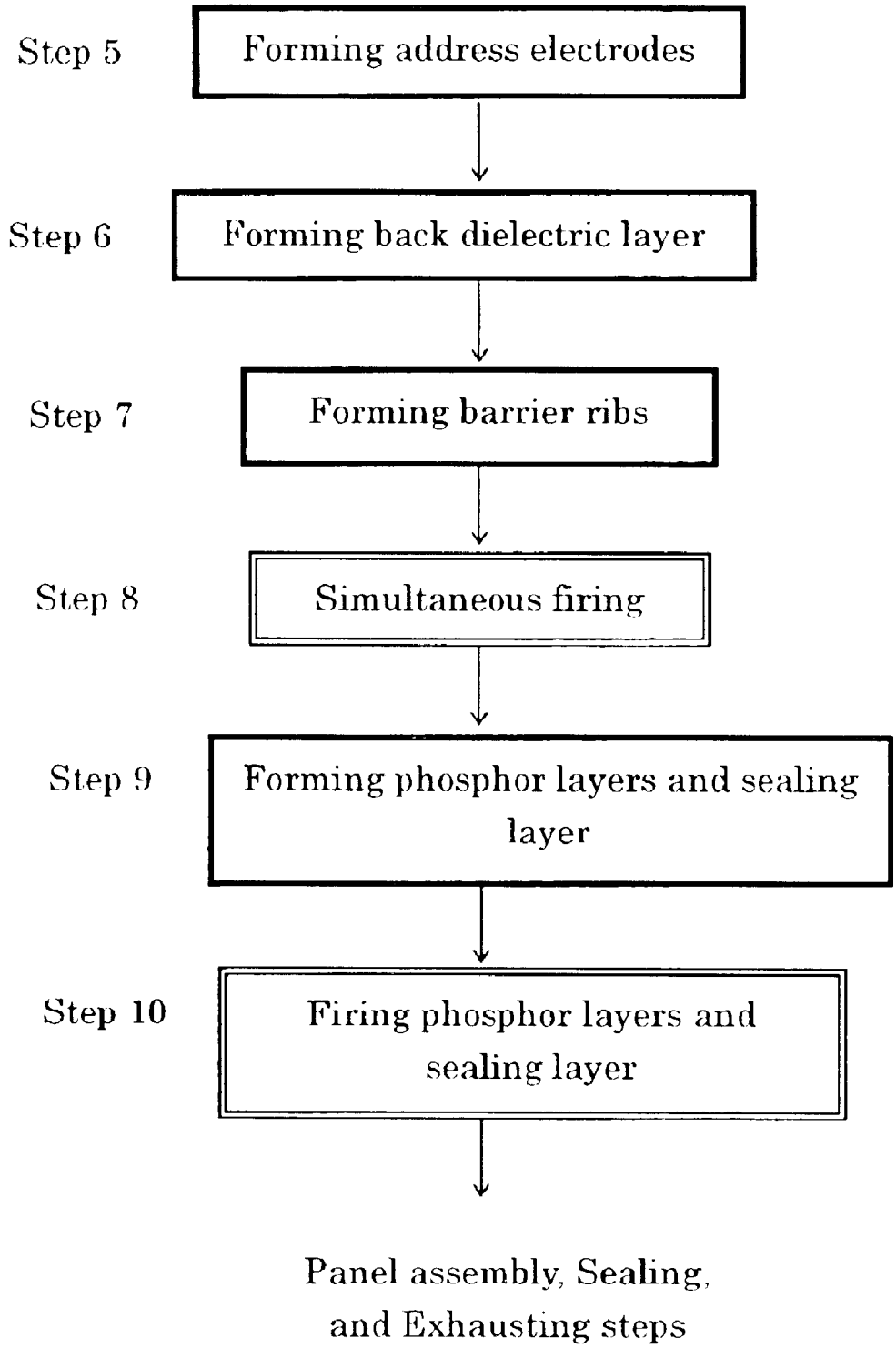
FIG. 5 is a flow chart showing a manufacturing process of a back panel according to the present invention.
Figure 6:
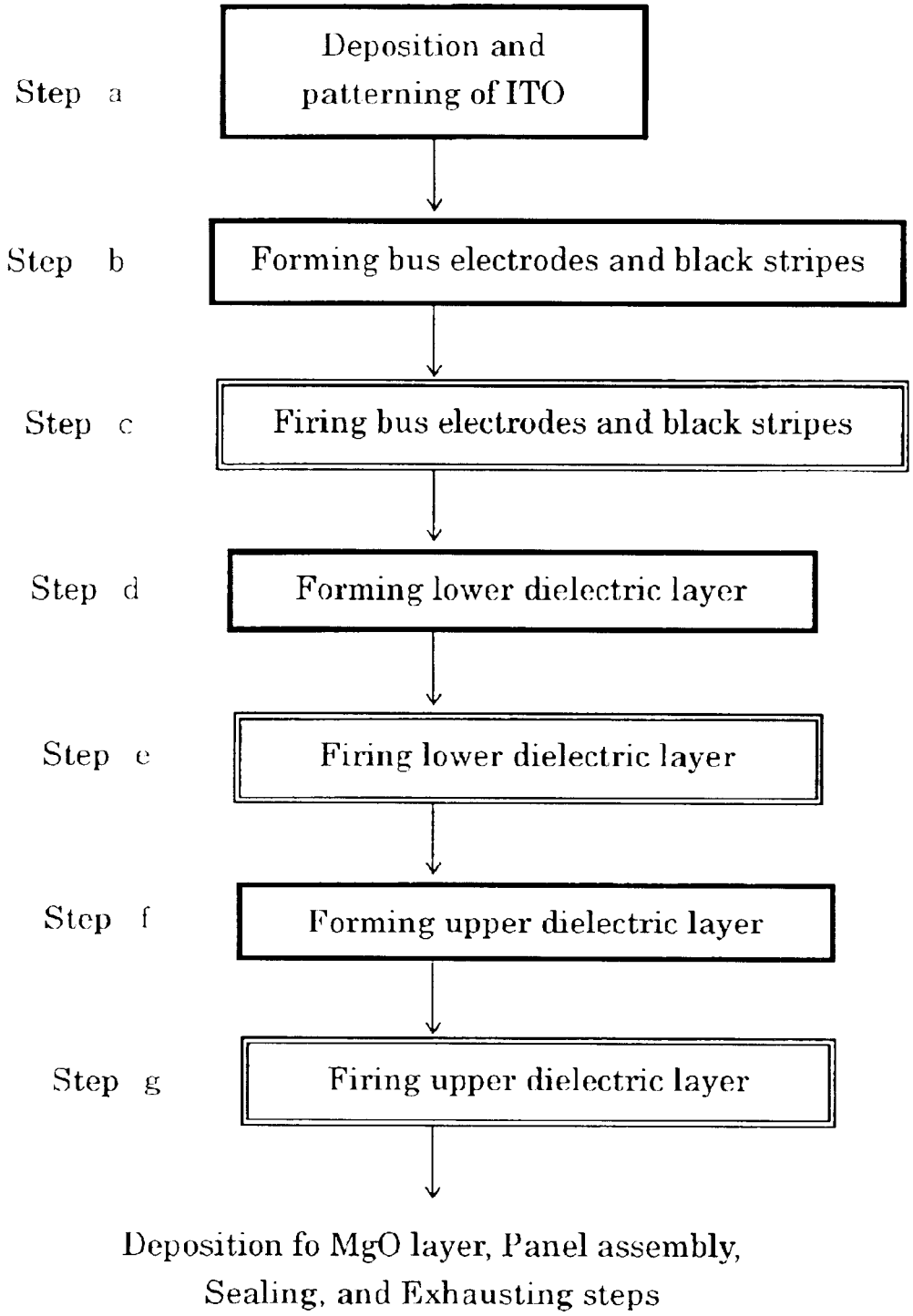
PRIOR ART Fig. 6
FIG. 6 is a flow chart showing a manufacturing process of a known front panel.
Figure 7:
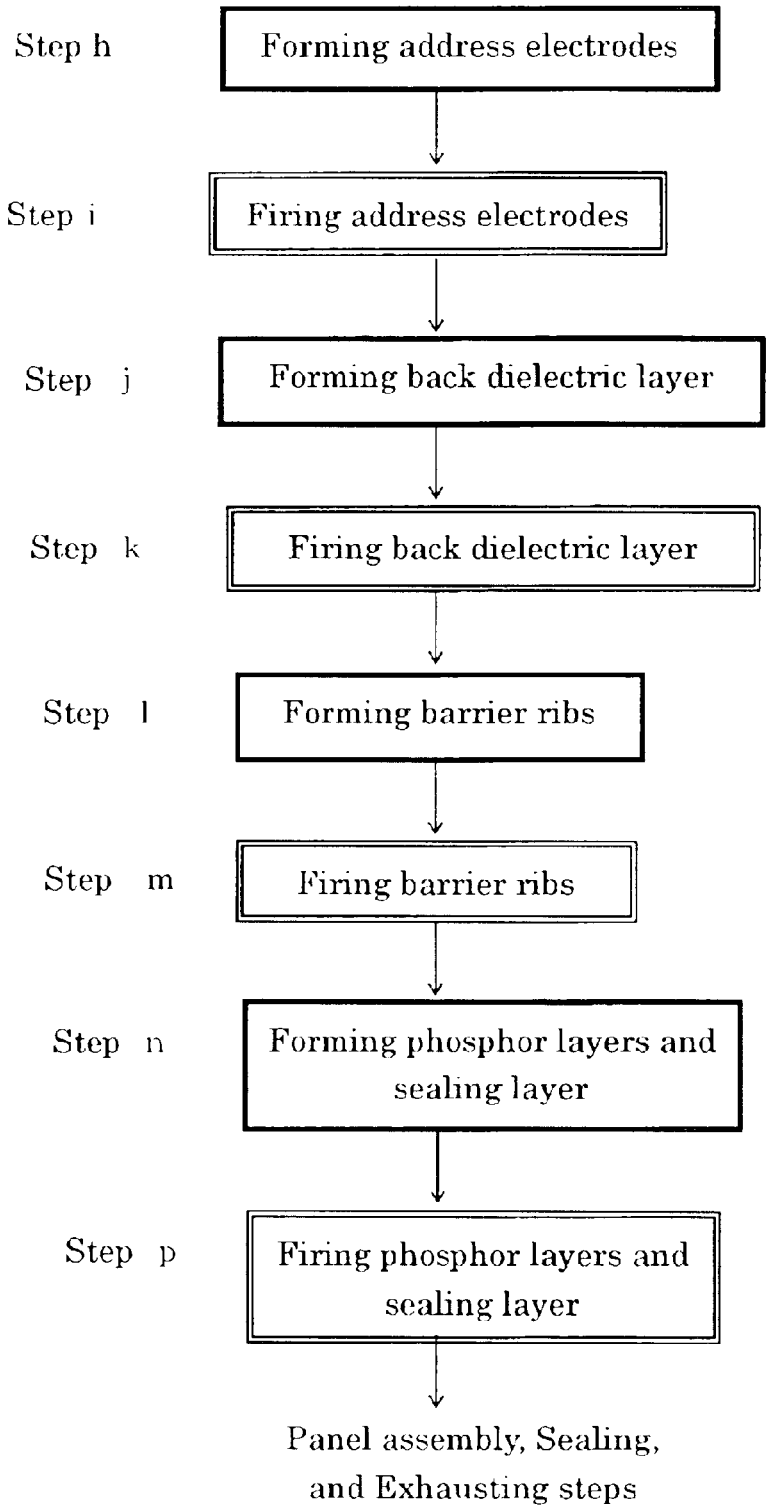
PRIOR ART Fig. 7
FIG. 7 is a flow chart showing a manufacturing process of a known back panel.

In step 5, address electrodes are formed on a back substrate as in the bus electrodes described in step 2 in FIG. 4.

In step 6, a back dielectric layer is formed on the address electrodes, as in the front dielectric layer described in step 3 in FIG. 4. The low-melting-point glass paste of the back dielectric layer contains well-known filler for increasing brightness or for dissipating excess charge accumulated on the surface of the back dielectric layer.

In step 7, barrier ribs are formed of a material containing, preferably, the same low-melting-point glass powder as in the back dielectric layer and filler, such as alumina or silica, for holding the shape of the barrier walls. The barrier ribs are formed by screen printing, sandblasting, thermal transfer, embossing, or the like. If thermal transfer or embossing is performed, the back dielectric layer and the barrier ribs may be formed simultaneously. In this instance, the barrier ribs are formed of the same paste as in the back dielectric layer.

In step 8, the address electrodes, the back dielectric layer, and the barrier ribs are fired simultaneously as in step 4 in FIG. 4. If temperature during firing is maintained constant, preferably, the period of time for maintaining the temperature is shorter than the firing time of the front panel in step 4 because an excessively long time is likely to deform the barrier ribs.

Finally, fluorescent phosphor pastes and a sealing paste are applied to predetermined regions by screen printing or using a dispenser in step 9 and are then fired in step 10 to complete the back panel.

If the ALIS plasma display panel shown in FIG. 3 is fabricated, the black stripes are not necessarily formed in step 2 in FIG. 4; instead, black films may be formed following step 7 in FIG. 5 and subsequently fired together with the back dielectric layer and the barrier ribs, or they may be formed in step 9 when forming the fluorescent phosphors. The black films are not necessary.

What is claimed is:

1. A plasma display panel assembly comprising:

a substrate;

electrodes disposed on the substrate, the electrodes comprising a metal containing a crystallized glass; and a dielectric layer covering the electrodes, the dielectric layer comprising a low-melting-point glass, wherein a crystallization peak temperature Tc of the crystallized glass is lower than a softening point Ts of the low-melting-point glass.

2. A plasma display panel assembly according to claim 1, wherein the dielectric layer and the electrodes are formed by simultaneously firing a low-melting-point glass paste and a metallic paste containing a metallic powder.

3. A plasma display panel assembly according to claim 2, wherein the metallic powder comprises silver or silver-palladium.

4. A front panel assembly of a plasma display panel, comprising:

a light-permeable substrate;

a plurality of display electrodes extending in one direction on the light-permeable substrate, the display electrodes each comprising a transparent conductive film and a metallic film containing a crystallized glass; and a dielectric layer covering the display electrodes, the dielectric layer comprising a low-melting-point glass, wherein a crystallization peak temperature Tc of the crystallized glass is lower than a softening point Ts of the low-melting-point glass.

5. A front panel assembly according to claim 4, further comprising light-shielding films comprising a black insulating material containing a crystallized glass, wherein display electrode pairs are each defined by two adjacent display electrodes, and each light-shielding film is disposed between one display electrode pair and another adjacent display electrode pair in parallel with the display electrodes.

6. A back panel assembly of a plasma display panel, comprising:

a substrate;

a plurality of address electrodes extending in one direction on the substrate, the address electrodes comprising a metal containing a crystallized glass;

a dielectric layer covering the address electrodes, the dielectric layer comprising a low-melting-point glass; and barrier ribs for partitioning discharge spaces on the dielectric layer, the barrier ribs comprising a low-melting-point glass, wherein a crystallization peak temperature Tc of the crystallized glass is lower than a softening point Ts of the low-melting-point glass.

7. A front panel assembly of a plasma display panel having a transparent substrate, a plurality of display electrode pairs on the transparent substrate, light-shielding films disposed between one display electrode pair and another adjacent display electrode pair in parallel with the display electrodes, and a dielectric layer covering the display electrodes, the improvement comprising:

each display electrode comprising a transparent conductive film and a metallic film containing a crystallized glass;

the dielectric layer comprising a low-melting-point glass; and the light-shielding films comprising a black insulating material containing a crystallized glass.

8. A front panel assembly of a plasma display having a transparent substrate, comprising:

plural display electrodes formed on the transparent substrate, each thereof comprising a transparent conductive film and a metallic film containing a crystallized glass;

light-shielding films disposed between adjacent display electrode pairs in parallel therewith and each comprising a black insulating material containing a crystallized glass; and a dielectric layer comprising a low-melting-point glass covering the display electrodes.

* * * * *